United States Patent [19]

Ishiwaka et al.

[11] Patent Number: 4,887,923

[45] Date of Patent: Dec. 19, 1989

[54] PLATEN ROLL

[75] Inventors: Takumi Ishiwaka; Yukio Andoh, both of Yokohama; Michiyuki Yamaguchi, Fuchu; Shosuke Suzuki, Kamakura; Yoshinori Egashira, Kodaira; Takeo Yokobori, Kamakura; Takashi Ohashi, Yokohama, all of Japan

[73] Assignee: Bridgestone Corporation, Tokyo, Japan

[21] Appl. No.: 59,302

[22] Filed: Jun. 8, 1987

[30] Foreign Application Priority Data

| | | | |
|---|---|---|---|
| Jun. 10, 1986 | [JP] | Japan | 61-132669 |
| Oct. 13, 1986 | [JP] | Japan | 61-241462 |
| Nov. 5, 1986 | [JP] | Japan | 61-261788 |
| Apr. 3, 1987 | [JP] | Japan | 62-80989 |
| Apr. 10, 1987 | [JP] | Japan | 62-86757 |
| Apr. 10, 1987 | [JP] | Japan | 62-86758 |

[51] Int. Cl.[4] ..... B41J 11/04

[52] U.S. Cl. ..... 400/659; 400/661; 400/662

[58] Field of Search ..... 400/659, 661, 661.1, 400/662; 29/130, 132; 428/457, 465, 466, 462, 461, 458

[56] References Cited

FOREIGN PATENT DOCUMENTS

| | | | |
|---|---|---|---|
| 62140 | 10/1982 | European Pat. Off. | 400/659 |
| 3114169 | 10/1982 | Fed. Rep. of Germany | 400/659 |
| 3406836 | 8/1984 | Fed. Rep. of Germany | 400/661 |
| 25974 | 2/1983 | Japan | 400/662 |
| 12880 | 1/1984 | Japan | 400/661 |
| 227474 | 12/1984 | Japan | 400/661 |
| 196374 | 10/1985 | Japan | 400/662 |
| 230877 | 11/1985 | Japan | 400/661 |
| 230878 | 11/1985 | Japan | 400/659 |
| 40177 | 2/1986 | Japan | 400/662 |
| 209177 | 4/1986 | Japan | 400/661.1 |
| 202867 | 9/1986 | Japan | 400/662 |
| 254366 | 11/1986 | Japan | 400/661.1 |
| 2089731A | 6/1982 | United Kingdom | 400/661 |

OTHER PUBLICATIONS

E. G. Souliere et al., "Molded Printer Platen", IBM Technical Disclosure Bulletin, vol. 23, No. 1, p. 17, Jun. 1980.

*Primary Examiner*—John J. Zimmerman

*Attorney, Agent, or Firm*—Sughrue, Mion, Zinn, Macpeak & Seas

[57] ABSTRACT

There is provided a platen roll low in generation of noise with keeping superior printability which comprises a shaft and a single layer of rubber composition concentrically and tightly applied around said shaft or two layers of an inner layer of a resin concentrically and tightly applied around said shaft and an outer layer of a rubber composition concentrically and tightly applied around said inner layer.

1 Claim, 2 Drawing Sheets

PLATEN ROLL

BACKGROUND OF THE INVENTION AND CONCERNED ART

This invention relates to a platen roll of impact type printer according to which noises caused at printing and the weight thereof can be reduced.

Conventional platen rolls used in printers of impact printing type are one, as shown in FIG. 1 (*a*), which comprises a metallic shaft 1 and a highly hard rubber layer 2 provided concentrically around the metallic shaft and one, as shown in FIG. 1 (*b*), which comprises a roll comprising integrally combined metallic shaft 1 and metallic cylinder 3 and highly hard rubber layer 2 provided outside said roll. Such platen rolls as above have been widely used. However, these platen rolls have the following problems:

(1) Loud noise occurs at printing and such noise is undesirable for health of operators and for indoor working environment.

(2) Weight of conventional platens is heavy and accordingly driving motor should be larger. There are not desired for compacting of devices and power saving.

Various attempts have been made to improve or modify the rolls which are considered to be main cause for occurrence of noises. There are proposals such as reduction of noises by reconstruction of shaft structure, namely, reduction of noises by increase of weight and reduction of noises by employing tube-like shaft and forming therein a foam layer of urethane as a vibration damping layer. However, these proposals have not been satisfactory. With reference to rubber, there have also been some proposals to reduce noises by employing a cover rubber of low hardness or by employing a two-layer surface cover rubber of a low hardness inner layer and a high hardness surface layer. These are also not preferred because of low printing ability.

SUMMARY OF THE INVENTION

It is one object of this invention to provide a platen roll according to which reduction of noises can be attained with keeping superior printability and besides, conventional health can be improved.

Further object of this invention is to provide a platen roller having practically enough characteristics as impact printers such as light weight, high stiffness, low cost, etc.

DESCRIPTION OF THE INVENTION

Figure 1:
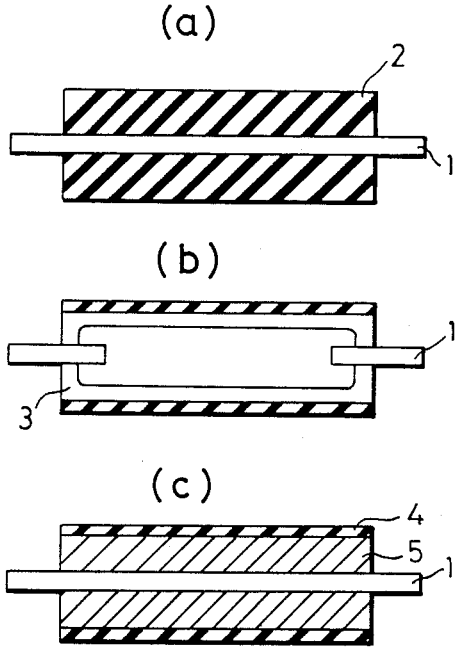
FIG.1 (PRIOR ART)
FIG. 1 (*a*) and (*b*) are longitudinal sectional views of conventional platen rolls and FIG. 1 (*c*) is a longitudinal sectional view of a platen roll in which inner layer is of unfoamed resin.

The inventors have made intensive researches on composition of noises of printers and mechanism of generation of noises in platen rolls to come to the following conclusions.

(1) The noises which are generated from platen roll include those directly generated by printing impact and those generated by vibration of platen roll due to the impact.

(2) Low elastic modulus and low loss factor are effective for the directly generated noises by printing, but high loss factor and low elastic modulus are desirable for the noises generated by vibration of platen roll.

(3) In actual cases, noises generated due to vibration of platen roll have also a considerable part in the noises caused by platen and thus materials of high loss factor and low elastic modulus are often desired.

(4) By employing a rubber of high loss factor, there can be attained reduction of solid noises of casing of printer which is generated by transmission of vibration generated by printing impact to the casing and thus overall reduction of noises can be accomplished.

Based on the above conclusions, the inventors have further made researches to obtain the fact that important characteristics of rubber composition are imporatant for reduction of noise and Es (5% stretch tensile modulus) which indicates spring property, tan δ which indicates viscosity and E′ (dynamic storage modulus of elasticity) for representing dynamic behavior are dominant therefor.

That is, with reference to the effect of tensile modulus Es, propagation rate of vibration is shown by $$Cp = \sqrt{\frac{(1-\mu)}{(1+\mu)(1-2\mu)}}\ \sqrt{\frac{E}{\rho}}\ (m/s)$$

in case of longitudinal wave and is shown by $$Cs = \frac{1}{\sqrt{2(1+\mu)}}\ \sqrt{\frac{E}{\rho}}\ (m/s)$$

in case of transversal wave. In these equations, $\mu$ is Poisson's ratio, E is tensile modulus (corresponds to Es here) and $\rho$ is density. When Poisson's ratio is small or quantity of deformation is slight, $\mu$ can be ignored and the propagation rate is proportional to $$\frac{E}{\rho}$$

both for longitudinal and transversal waves. As is clear from the above, the smaller the modulus of elasticity Es is, the slower the propagation rate is and thus reduction of noises can be attained by diffusion of vibration energy, etc.

The tan δ which shows viscosity indicates the transformation of vibration to heat energy and a large tan δ indicates that vibration of roll generated by impact rapidly decreases and accordingly, the noise generated by resonance of roll is reduced.

With reference to the effect of E′ which shows dynamic behavior, explanation thereof will be given as follows. That is, the contact time of printing hammer at impacting is an important factor which specifies input to roll and this contact time is determined by E′. Short contact time indicates that region of frequency which causes vibration phenomenon of roll is wide and as a result, vibration of high frequency region which mainly constitutes resonance of roll becomes greater than that of longer contact time and thus, level of noise in this high frequency region becomes higher. Therefore, decrease of E′ is effective for reduction of noise in high frequency region.

These properties, especially Es and E' are contrary to clearness of printed letters which is the main function of printer. Under the circumstances, the inventors have found that there are optimum ranges of the physical properties and accomplished this invention.

That is, optimum ranges of physical properties of rubber composition having noise reduction effect are Es of 200–500 kg/cm$^2$ and tan δ of 0.15–0.50. Within these ranges, printing clearness and noise reduction are compatible with each other, but it is further desirable that E' is within the range of 600–1800 kg/cm$^2$.

When Es is more than 500 kg/cm$^2$, the elastic modulus becomes too high and reduction of noise cannot be attained for the above mentioned reasons and when less than 200 kg/cm$^2$, printability becomes inferior to cause problems such as blur of transferred letters such as M and W in impact printers using printing types. When tan δ is less than 0.15, vibration of roll generated by printing impact becomes greater to cause load noise and thus overall reduction of noise cannot be attained although noise generated directly by printing can be decreased, and further, when tan δ is more than 0.5 of high loss factor, contact time at the time of printing impact becomes shorter and there is provided substantially the same effect as when a hard rubber is used, but the high loss factor increases temperature dependency of tensile modulus and then the printing quality becomes worse.

The above-mentioned two ranges of the properties must be simultaneously satisfied and if either one of them is not satisfied, effective reduction of noises cannot be attained.

As in the case of Es, when E' is less than 600 kg/cm$^2$, printing quality becomes inferior and when more than 1800 kg/cm$^2$, reduction of noises cannot be accomplished.

Rubber compositions which show the above-mentioned optimum properties in case of one-layer structure are (1) those which contain 100 parts by weight or less of carbon per 100 parts by weight of total rubber in which 30–70% by weight of natural rubber or isoprene rubber is containing, (2) those which comprises thermoplastic elastomer or (3) those which contain at least one of styrene-butadiene copolymer rubber, nitrile-butadiene copolymer rubber, butyl rubber and halogenated butyl rubber and at least one of polystyrene resin, phenolic resin, reinforced rubber composition comprising a vulcanizable rubber on which is grafted a short fiber of a thermoplastic polymer having $$\leftarrow \overset{\overset{\displaystyle O}{\|}}{C} - NH \rightarrow$$

group in a molecule through a precondensate of phenol-formaldehyde resin and copolymer comprising conjugated diolefin, ethylenically unsaturated carboxylic acid and vinyl monomer.

When a high stiffness is required for platen roll in some uses or light weight is desired, a platen roll of two-layer structure composed of an outer layer of rubber composition and an inner layer of resin layer is desired.

Rubber compositions in the two-layer structure include, in addition to the above three compositions, (1) those which comprise at least one of natural rubber, polyisoprene rubber, styrene-butadiene copolymer rubber, polychloroprene, ethylene-propylene copolymer rubber, polybutadiene rubber (including 1,2-polybutadiene resin), polyurethane rubber, polyacrylate rubber and polynorbornane rubber and (2) those which comprise at least one of natural rubber, polyisoprene rubber, styrene-butadiene copolymer rubber, polychloroprene rubber, ethylene-propylene copolymer rubber and polybutadiene rubber, and a reinforced rubber composition comprising a vulcanizable rubber on which is grafted a short fiber of a thermoplastic polymer having $$\leftarrow \overset{\overset{\displaystyle O}{\|}}{C} - NH \rightarrow$$

group in a molecule through a precondensate of phenol-formaldehyde resin, content of the short fiber of thermoplastic polymer in the rubber composition being 2–30 parts by weight per 100 parts by weight of the total rubber component.

As resin materials constituting the inner layer, thermoplastic resins such as ABS resin, polystyrene resin, polyethylene resin, polypropylene resin, polyamide resins, AS resin, noryl resin, etc. and thermosetting resins such as phenolic resin, epoxy resin, unsaturated polyester resin, diallyl phthalate resin, rigid polyurethane resin, etc. are enumerated. These resins may have a flexural modulus in flexure of 20,000–150,000 kg/cm$^2$ for unfoamed resins and 15,000–35,000 kg/cm$^2$ for foamed resins. These resins may be used alone or in admixture. The platen roll rotates while being continuously beaten by impact head during printing. Therefore, if the roll undergoes bending, deformation, etc. by the external force, these may become sources for noises and besides cause loss of printing suitability. Thus, the roll must have sufficient stiffness. For this purpose, resins used as inner layer must have the flexural modulus within the above-mentioned ranges.

The above-explained two-layer structure is preferably formed of outer layer of 2–5 mm thick and inner layer of 10–25 mm thick concentrically and integrally around a metallic shaft. In this case, degree of freedom of the outer layer rubber composition enlarged because the contact time specified by the inner resin layer or by E' of rubber single substance in case of single layer is influenced.

Here, rubber composition in case of rubber single layer will be explained in more detail.

As rubber compositions which show the above-mentioned optimum ranges of properties, there has been referred to, hereabove, (1) those which contain isoprene rubber containing 100 parts by weight or less of carbon per 100 parts by weight of total rubber, said rubber part containing 30–70% by weight of isoprene or natural rubber. In this case, natural rubber and isoprene rubber are excellent in processability and temperature dependence and are low in ratio of dynamic storage modulus to static modulus (E'/Es) and so they are suitable for obtaining the optimum ranges of the physical properties. When content of natural rubber (NR) or isoprene rubber (IR) is less than 30% by weight, temperature dependence is high and when more than 70% by weight, loss factor is too low and compatibility of reduction of noise and good printability is difficult to keep. When carbon content is more than 100 parts by weight, processability becomes poor to cause practical difficulties. More preferably, amount of vulcanizer (amount of sulfur) is 7–12 parts by weight per 100 parts by weight of polymers because this also affects Es and E'. Therefore, it is desirable to set the glass transition temperature (peak temperature of tan δ) at 80 Hz at 10° C. or lower.

In order to obtain rubbery elastic materials of the above ranges of properties, (2) there may also be used urethane or olefin elastomer because thermoplastic elastomers are especially superior in temperature dependence.

Furthermore, in order to attain reduction of noises, it is desired to improve temperature dependence within the range of tan δ of 0.15–0.5 specified hereinabove, especially, on higher loss factor side. Rubber compositions preferred for this purpose are (3) those which contain at least one of styrene-butadiene copolymer rubber (SBR), nitrile-butadiene rubber (NBR), butyl rubber and halogenated butyl rubbers (IIR, Br-IIR, Cl-IIR) as high loss factor type polymers and at least one of polystyrene resin, phenolic resin, reinforced rubber composition comprising a vulcanizable rubber on which short fiber of a thermoplastic polymer having $$\left(\overset{O}{\overset{\|}{C}}-NH\right)$$

group in a molecule is grafted through a phenolformaldehyde precondensate and copolymers comprising conjugated diolefin, ethylenically unsaturated carboxylic acid and other vinyl monomers copolymerizalble therewith for improvement of temperature dependence of E′ and Es. In this case, it is suitable that the high loss factor type polymer is contained in an amount of 30–90% by weight in total polymers and the polymer for improvement of temperature dependence is contained in an amount of 10–40% by weight in the total polymers. The copolymer containing ethylenically unsaturated carboxylic acid preferably contains the carboxylic acid in an amount of 0.5–20% by weight. Furthermore, there may be unobjectionably added, as a third component, at least one of natural rubber, isoprene rubber, acrylic rubber, neoprene rubber, ethylene-propylene rubber, butadiene rubber, etc. In this case, it is preferred that amount of other additives such as sulfur is adjusted so that the peak temperature of loss factor provided by the polymers other than those for improvement of temperature dependence is 10° C. or lower.

As explained hereinabove, reduction of noise generated by platen roll and printer has been attained by the rubber composition according to this invention. Furthermore, high stiffness and weight-saving have been attained by employing two-layer structure by application of resin.

The following nonlimiting examples illustrate this invention. Examples 1–6 and Comparative Examples 1–3 relate to single-layer structure and Examples 7–15 and Comparative Examples 4 and 5 relate to two-layer structure.

EXAMPLE 1

A rubber composition 4a was prepared by adding 50 parts by weight of FEF carbon and other additives to 40 parts by weight of natural rubber (NR), 30 parts by weight of styrene-butadiene copolymer rubber (SBR) and 30 parts by weight of styrene post-added styrene-butadiene copolymer rubber (HSR), kneading them by common method and subjecting the mixture to proper vulcanization. This rubber composition was concentrically and tightly applied around a metal shaft 1 of 14 mm and subjected to polishing treatment to obtain a platen roll (FIG. 2*a*).

EXAMPLE 2

Figure 2:
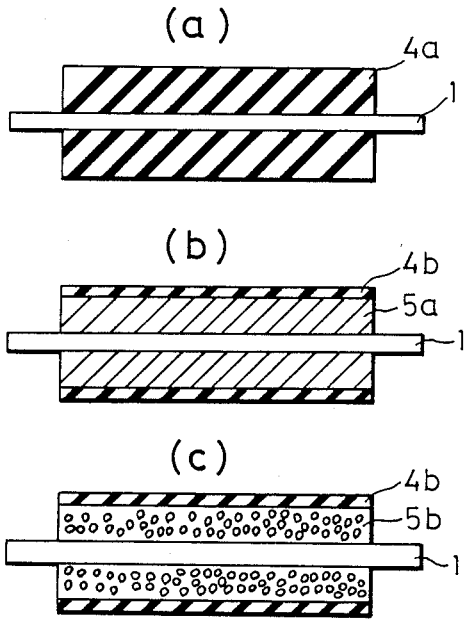
FIG. 2 (*a*), (*b*) and (*c*) are respectively a longitudinal sectional view of a platen roll of this invention.

To 80 parts by weight of NBR and 30 parts by weight of FRR were added 70 parts by weight of FEF carbon and other additives and a platen roll was made therefrom in the same manner as in Example 1 (FIG. 2*a*).

EXAMPLE 3

To 80 parts by weight of NBR and 20 parts by weight of phenolic resin were added 70 parts by weight of FEF carbon and other additives and a platen roll was made therefrom in the same manner as in Example 1 (FIG. 2*a*).

EXAMPLE 4

To 40 parts by weight of SBR, 40 parts by weight of isoprene rubber and 20 parts by weight of HSR were added 70 parts by weight of FEF carbon and other additives and a platen roll was made therefrom in the same manner as in Example 1 (FIG. 2*a*).

EXAMPLE 5

To 80 parts by weight of SBR and 20 parts by weight of SBR (SBMA 58) containing an ethylenically unsaturated carboxylic acid were added 70 parts by weight of FEF carbon and a platen roll was made therefrom in the same manner as in Example 1 (FIG. 2*a*).

EXAMPLE 6

70 parts by weight of FEF carbon and other additives were added to 40 parts by weight of SBR, 15 parts by weight of brominated butyo rubber, 15 parts by weight of isoprene rubber (IR) and 15 parts by weight of HSR and a platen roll was made in the same manner as in Example 1 (FIG. 2*a*).

COMPARATIVE EXAMPLE 1

To 100 parts by weight of SBR were added 90 parts by weight of FEF carbon and other additives and a platen roll was made therefrom in the same manner as in Example 1 (FIG. 1*a*).

COMPARATIVE EXAMPLE 2

To 60 parts by weight of IR and 40 parts by weight of HSR were added 70 parts by weight of FEF carbon and other additives and a platen roll was made therefrom in the same manner as in Example 1 (FIG. 1*a*).

COMPARATIVE EXAMPLE 3

To 100 parts of NBR were added 70 parts by weight of FEF carbon and other additives and a platen roll was made therefrom in the same manner as in Example 1 (FIG. 1*a*).

Details of blending ratios, properties, noise characteristics and printability obtained in the above examples and comparative examples were shown in Table 1.

FRR used in the examples is a reinforced rubber obtained by kneading 50 parts by weight of 6-nylon (1030B produced by Ube Indusbries Ltd.) and 2.14 parts by weight of a novolak type phenolformaldehyde precondensate (550PL produced by Showa Chemical Co.) with 100 parts by weight of natural rubber and then carrying out graft reaction of them. Details of the production method is described in Japanese Patent Application No. 76313/86. SBMA 58 is obtained by charging water, butadiene, styrene, potassium t-dodecylbenzenesulfonate, methacrylic acid, t-dodecylmercaptan and potassium persulfate in an autoclave of 5 liters, purging the system with nitrogen, then carrying out polymerization at 60° C., stopping the polymerization at a conversion of 70% with dimethylthiocarbamate and adding a phenolic aging inhibitor, followed by coagulation and drying by conventional manner. This copolymer is composed of 70.5% by weight of butadiene 22.5% by weight of styrene and 7.0% by weight of methacrylic acid. Detail of method for production of this copolymer is described in Japanese Patent Unexamined Publication No. 187039/84. Improving effects of temperature dependence of these FRR and SBMA are considered due to fiber reinforcement for the former and formation of ethylenically unsaturated carboxylic acid combined compound for the latter.

The physical properties, Es, E' and tan δ were measured by a viscoelasticity spectrometer (type VES manufactured by Iwamoto Seisakusho Ltd.). The sample used was in the form of strip of 5 mm width, 50 mm length and 0.5 mm thickness. This sample was fixed at a distance of 30 mm and was pre-stretched by 10%, then restored to the original length (that is, length by which tensile load becomes zero) and stretched again by 5% and 5% Es (tensile modulus at stretching by 5%) was calculated from the value after lapse of 20 seconds. Pulling rate was 1 cm/min. Dynamic storage modulus of elasticity (E') and loss factor (tan δ) were measured by the same apparatus by applying vibration of 100 Hz, ±0.3% amplitude using the sample of 5% stretching as a starting point.

Glass transition temperature was measured by applying a dynamic shear strain of ±0.05−±0.2% at 80 Hz by Dynamic spectrometer RDA-700 manufactured by Rheometrics Co. on a columnar sample of 8 mm diameter×6 mm height. The peak temperature of loss factor at from −40° C. to 80° C. corresponds to the above glass transition temperature. When two peaks are present, the lower one is due to the rubber part and so this lower one is employed.

The effect of reduction of noise generated by a platen roll was measured by mounting an actually produced roll on a printer and carrying out printing by this printer. The printer was put on a table of 70 cm in height and a microphone was placed at a horizontal position 100 cm in front of the printer. The printer was operated with a printing paper being present and level of noise was measured. The results are shown as overall values (referred to as "O.A value" hereinafter). The results of measurement of noise are shown as relative values when the result in Comparative Example 1 was 0 dBA. Negative values mean level of noise lower than that in Comparative Example 1.

In addition, printability was visually evaluated by repeated striking of edgy letters M and W.

TABLE I (single-layer structure)

| | Examples | | | | | | Comparative Examples | | |
|---|---|---|---|---|---|---|---|---|---|
| | 1 | 2 | 3 | 4 | 5 | 6 | 1 | 2 | 3 |
| SBR 1 | 30 | | | 40 | 80 | 40 | 100 | | |
| NBR 2 | | 80 | 80 | | | | | | 100 |
| Br-IIR 3 | | | | | | 15 | | | |
| IR 4 | | | | 40 | | 30 | | 60 | |
| SBMA 5 | | | | | 20 | | | | |
| HSR 6 | 30 | | | 20 | | 15 | | 40 | |
| FRR 7 | | 30 | | | | | | | |
| Phenolic resin 8 | | | 20 | | | | | | |
| NR | 40 | | | | | | | | |
| Carbon 9 | 50 | 70 | 70 | 70 | 70 | 70 | 90 | 70 | 70 |
| Process oil | 5 | 10 | 10 | 15 | 15 | 15 | 10 | 5 | 10 |
| Zinc White | 3 | 3 | 5 | 5 | 10 | 5 | 3 | 5 | 5 |
| Stearic acid | 1 | 1 | 1 | 1 | 1 | 1 | 1 | 1 | 1 |
| Sulfur | 10 | 5 | 5 | 10 | 10 | 10 | 18 | 8 | 10 |
| Vulcanization accelerator | 2 | 2 | 2 | 2 | 2 | 2 | 3.6 | 2 | 2 |
| Es | 285 | 245 | 425 | 395 | 298 | 260 | 430 | 57.0 | 420 |
| E' | 997 | 870 | 1555 | 1370 | 1045 | 975 | 2630 | 1950 | 2400 |
| tanδ | 0.25 | 0.37 | 0.43 | 0.26 | 0.29 | 0.32 | 0.38 | 0.08 | 0.54 |
| Glasstransition temparature | −10 | 0 | 5 | −8 | −5 | −8 | 25 | −20 | 20 |
| Level of noise (dBA) | −3.3 | −4.2 | −2.7 | −2.5 | −3.0 | −3.5 | 0 | +1.2 | −0.4 |
| Printability | good | good | good | good | good | good | good | good | good |

1 SBR 1502 of Japan Synthetic Rubber Co.
2 NBR N230SL of Japan Synthetic Rubber Co.
3 Brominated butyl rubber X2 (Br content 2.0%) of Polycer Co.
4 IR2200 of Japan Synthetic Rubber Co.
5 SBMA 58 (butadiene 70.5 wt %, styrene 22.5 wt % and methacrylic acid 7.0 wt %) of Japan synthetic Rubber Co.
7 FRR (NR: nylon short fiber = 7:1) of Ube Industries Ltd.
8 Phenolic resin 12687 of Sumitomo Dulles Co.
9 FEF of Tokai Carbon Co.

From the above results, remarkable reduction of noise was recognized in Examples 1-6 of this invention as compared with that of Comparative Example 1 and furthermore, the printability was superior in Examples 1-6. It is further recognized that in the comparative examples where Es, E' and tan δ are outside the ranges specified in this invention, no reduction of noise was seen although the printability was acceptable. Furthermore, significant difference was clearly recognized in blending ratios of components to obtain the specific ranges of the physical properties.

The following examples show the two-layer structure.

EXAMPLE 7

A rubber composition for outer layer 4b which comprised 130 parts by weight of resin modified ethylene-propylene copolymer and 100 parts by weight of carbon black and which had a 5% stretch tensile modulus of 320 kg/cm$^2$, a tan δ of 0.181 and a hardness of 98, and ABS resin (ABS-300 of Nippon Steel Chemical Co., Ltd.) for inner layer 5a were concentrically and integrally molded around a metallic shaft 1 of 10 mm in diameter at a thickness of 10 mm for the inner layer and 3 mm for the outer layer to obtain a platen roll.

EXAMPLE 8

A rubber composition for outer layer 4b which comprised 40 parts by weight of natural rubber, 60 parts by weight of styrene-butadiene copolymer and 90 parts by weight of carbon black and which had a 5% stretch tensile modulus of 310 kg/cm$^2$, a tan δ of 0.232 and a hardness of 98, and the ABS resin used in Example 7 for an inner layer 5a were concentrically and integrally molded around the metallic shaft 1 at a thickness of 10 mm for the inner layer and 3 mm for the outer layer to obtain a platen roll.

EXAMPLE 9

A rubber composition for outer layer 4b which comprised 50 parts by weight of natural rubber, 40 parts by weight of styrene-butadiene copolymer, 10 parts by weight of FRR and 90 parts by weight of carbon black and which had a 5% stretch tensile modulus of 330 kg/cm$^2$, a tan δ of 0.189 and a hardness of 98, and the ABS resin used in Example 7 for an inner layer 5a were concentrically and integrally molded around the metallic shaft 1 at a thickness of 10 mm for the inner layer and 3 mm for the outer layer to obtain a platen roll.

EXAMPLE 10

A rubber composition for outer layer 4b which comprised 80 parts by weight of styrene-butadiene copolymer, 20 parts by weight of FRR and 50 parts by weight of carbon black and which had a 5% stretch tensile modulus of 470 kg/cm$^2$, a tan δ of 0.468 and a hardness of 97, and the ABS resin used in Example 7 for inner layer 5a were concentrically and integrally molded around the metallic shaft 1 at a thickness of 10 mm for the inner layer and 3 mm for the outer layer to obtain a platen roll.

EXAMPLE 11

The same rubber composition for outer layer 4b as used in Example 7 and an ABS resin (ABS-300 of Nippon Steel Chemical Co., Ltd.) for inner layer 5b which was foamed using a master pellets of ABS resin containing a foaming agent were concentrically and integrally molded around core 1 of a metallic shaft of 10 mm in diameter at a thickness of 10 mm for the inner layer and 3 mm for the outer layer to obtain a platen roll.

EXAMPLE 12

A platen roll was made in the same manner as in Example 7 except that the polystyrene foam (H-45 of foaming grade of Nippon Steel Chemical Co., Ltd.) was used for inner layer 5b.

EXAMPLE 13

A platen roll was made by concentrically and integrally molding the same rubber composition as of Example 8 for outer layer 4b and the same ABS resin and foaming agent as of Example 11 for inner layer 5b around core 1 at a thickness of 10 mm for the inner layer and 3 mm for the outer layer.

EXAMPLE 14

A platen roll was made by molding concentrically and integrally the same rubber composition as of Example 9 for outer layer 4b and the same ABS resin as of Example 11 for inner layer 5b around the metallic shaft 1 at a thickness of 3 mm for the outer layer and 10 mm for the inner layer.

EXAMPLE 15

A platen roll was made by molding concentrically and integrally the same rubber composition as of Example 10 for outer layer 4b and the same ABS resin as of Example 11 for inner layer 5b around the metallic shaft 1 at a thickness of 3 mm for the outer layer and 10 mm for the inner layer.

COMPARATIVE EXAMPLE 4

A rubber composition for outer layer 4 which comprised 100 parts by weight of styrene-butadiene copolymer and 80 parts by weight of carbon black and had a 5% stretch tensile modulus of 523 kg/cm$^2$, tan δ of 0.466 and a hardness of 97, and the same resin as of Example for inner layer 5 were concentrically and integrally molded around the same the metallic shaft 1 as of Example 7 at a thickness of 10 mm for the inner layer and 3 mm for the outer layer to obtain a platen roll.

COMPARATIVE EXAMPLE 5

Around a roll of a hollow cylinder having an inner diameter of 24 mm and an outer diameter of 30 mm and having a metallic shaft 1 of 10 mm diameter projected from both ends of the roll as shown in FIG. 1 (*b*) was tightly applied a thermosetting polyurethane rubber having a 5% stretch tensile modulus of 842 kg/cm$^2$, a tan δ of 0.114 and a hardness of 98 at a thickness of 3 mm to obtain a platen roll.

Details of Examples 7–15 and Comparatives 4 and 5 were shown in Table 2. Evaluation was effected in the same manner as in the case of single layer structure.

TABLE 2

| | Example 11 | Example 12 | Example 13 | Example 14 | Example 15 | Example 7 | Example 8 | Example 9 | Example 10 | Comparative Example 4 | Comparative Example 5 |
|---|---|---|---|---|---|---|---|---|---|---|---|
| Blend | | | | | | | | | | | |
| Resin modified ethylene propylene copolymer (1) (Resin: 1,2-polybutadiene resin) (2) | 130 | 130 | | | | 130 | | | | | |
| Natural rubber | | | 40 | 50 | | | 40 | 50 | | | |
| FRR (3) | | | | 10 | 20 | | | 10 | 20 | | |

TABLE 2-continued

| | | Example 11 | Example 12 | Example 13 | Example 14 | Example 15 | Example 7 | Example 8 | Example 9 | Example 10 | Comparative Example 4 | Comparative Example 5 |
|---|---|---|---|---|---|---|---|---|---|---|---|---|
| Outer layer | Styrene-butadiene copolymer (4) | | | 60 | 40 | 80 | | 60 | 40 | 80 | 100 | |
| | carbon black (5) | 100 | 100 | 90 | 90 | 50 | 100 | 90 | 90 | 50 | 80 | |
| | Polyurethane rubber (6) | | | | | | | | | | | 100 |
| | Property | | | | | | | | | | | |
| | 5% stretch tensile modulus (kg/cm$^2$) (7) | 320 | 320 | 310 | 330 | 470 | 320 | 310 | 330 | 470 | 523 | 842 |
| | Tanδ (8) | 0.181 | 0.181 | 0.232 | 0.189 | 0.468 | 0.181 | 0.232 | 0.189 | 0.468 | 0.466 | 0.114 |
| | Hardness (JIS-A) | 98 | 98 | 98 | 98 | 97 | 98 | 98 | 98 | 97 | 97 | 98 |
| | Thickness (mm) | 3 | 3 | 3 | 3 | 3 | 3 | 3 | 3 | 3 | 3 | 3 |
| | Blend | | | | | | | | | | | |
| | ABS resin (9) | 100 | | 100 | 100 | 100 | 100 | 100 | 100 | 100 | 100 | |
| | Foaming agent (10) | 5 | | 5 | 5 | 5 | | | | | | |
| | Polystyrene resin form (11) | | 100 | | | | | | | | | Metallic cylinder 30 mm ϕ |
| Inner layer | Property | | | | | | | | | | | |
| | Flexural modulus (kg/cm$^2$) | 20000 | 21000 | 20000 | 20000 | 20000 | 25500 | 25500 | 25500 | 25500 | 25500 | |
| | Thickness (mm) | 10 | 10 | 10 | 10 | 10 | 10 | 10 | 10 | 10 | 10 | |
| Shaft | Metallic (diameter mm) | 10 ϕ | 10 ϕ | 10 ϕ | 10 ϕ | 10 ϕ | 10 ϕ | 10 ϕ | 10 ϕ | 10 ϕ | 10 ϕ | |
| Result of evaluation | Weight (gr) | 760 | 768 | 772 | 767 | 763 | 817 | 822 | 818 | 817 | 820 | 885 |
| | Level of noise (O.A.)dBA | 66.0 | 65.7 | 65.9 | 65.4 | 66.2 | 65.8 | 64.9 | 65.1 | 66.0 | 67.7 | 68.6 |
| | Printability | good | good | good | good | good | good | good | good | good | good | good |

(1) EP-51 of Japan Synthetic Rubber Co.
(2) RB-805 of Japan Synthetic Rubber Co.
(3) 6-Nylon fiber-reinforced natural rubber
(4) SBR-1507 of Japan Synthetic Rubber Co.
(5) FEF-Black of Asahi Carbon Co.
(6) Hardened product of DC-6912 Prepolymer of Japan Polyurethane Co. with Curemin MT of Ihara Chemical Co.
(7) This was measured at room temperature.
(8) This was measured at room temperature with 100 Hz, 0.3% strain.
(9) ABS-300 of Nippon Steel Chemical Co., Ltd.
(10) EB-106 of Eiwa Kasei Kogyo Co.
(11) H-45 Foam Grade of Nippon Steel Chemical Co., Ltd.

Figure 3:
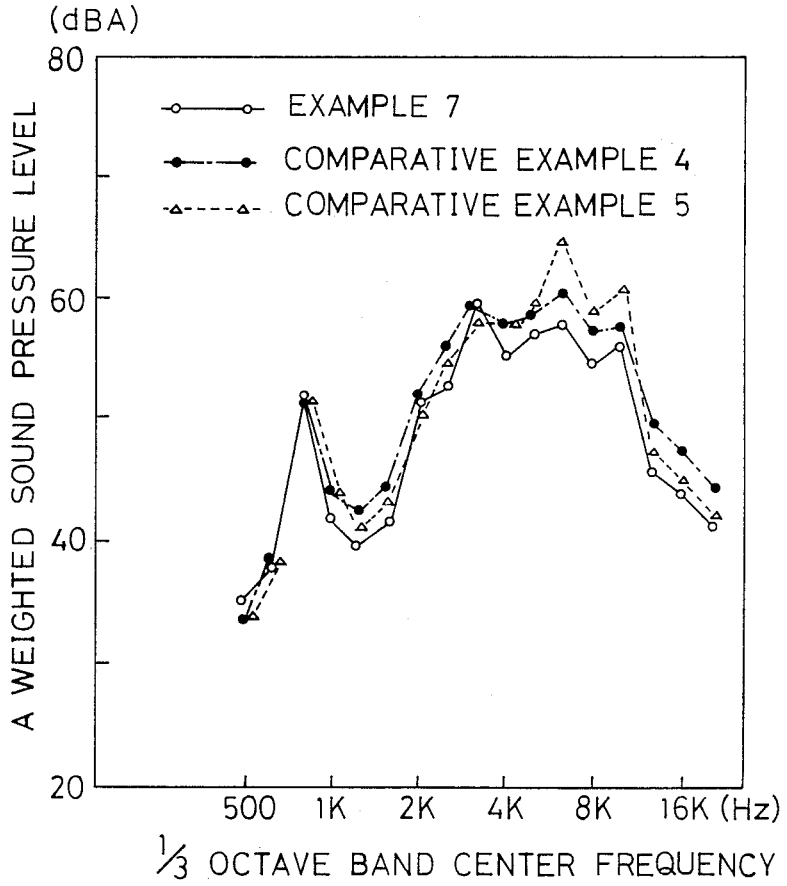
FIG. 3 is a graph which compares noise level of the platen roll of this invention with those of comparative samples.

As is clear from the results shown in Table 2, the platen rolls of Examples 7–15 were superior to those of Comparative Examples 4 and 5. Especially, results of analysis of frequency of noises in the comparative examples and Example 7 are shown in FIG. 3, according to which level of noise was reduced by 3–7.5 dB at 4K–8K Hz in Example 7 as compared with in the comparative examples and thus effect of reduction in noise was clearly recognized in Example 7. On the other hand, printability was good equally in the examples and the comparative examples. There was substantially no difference in weight of platen rolls of Examples 7–10 and Comparative Example 4, but in comparison with the weight of the platen roll of Comparative Example 5, the weight of the platen rolls of Examples 7–10 was lighter by 7–8% and besides the effect of reduction of noise was higher in Examples 7–10.

The platen rolls of Examples 11–15 where resin foams were used were lighter in weight by 6–7% than those of Examples 7–10 where non-foamed resin was used with the same rubber compositions in the outer layer and they were similar in effect of reduction of noise. Thus, it will be recognized that the platen rolls of Examples 11–15 were further superior. The inferiority of the platen roll of Comparative Example 5 in reduction of noise seems to be due to the inferiority in characteristic of the outer layer rubber (higher Es). Furthermore, the platen rolls of Examples were markedly superior in weight-saving and reduction of noise to the platen roll of Comparative Example 4 which has been hitherto widely employed.

As explained in detail hereinabove, the platen rolls of this invention are great in weight-saving and besides effective in reduction of noise. Furthermore, energy saving and compacting of devices by miniaturization of motor become possible without damaging the printability. Moreover, working circumstance can be improved. In addition, the effect of the outer layer rubber is great in reduction of noise even when resins are not applied, although weight-saving cannot be attained.

What is claimed is:

1. A platen roll which comprises a metallic shaft as a core and a surrounding component, wherein said surrounding component is selected from the group consisting of:

(A) a single layer comprising a rubber composition concentrically and tightly applied around said core, and (B) two layers comprising (i) an inner layer of a resin concentrically and tightly applied around said core and, (ii) an outer layer of a rubber composition concentrically and tightly applied around said inner layer, wherein said rubber composition comprising the single layer comprises:

(1) a composition containing 100 parts by weight or less of carbon based on 100 parts by weight of total rubber, and 30–70% by weight of a natural rubber or an isoprene rubber, (2) a composition comprising a thermoplastic elastomer, or (3) a composition containing (i) at least one member selected from the group consisting of a styrene-butadiene copolymer rubber, an acrylonitrile-butadiene copolymer rubber, a butyl rubber and a halogenated butyl rubber, and (ii) at least one member selected from the group consisting of a polystyrene resin, a phenolic resin, a reinforced rubber composition comprising a vulcanizable rubber on which short fiber of a thermoplastic polymer having a

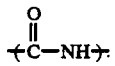

group in the molecule is grafted through a phenol-formaldehyde resin precondensate and a copolymer comprising a conjugated diolefin-ethylenically unsaturated carboxylic acid and another vinyl monomer, wherein said rubber composition comprising the single layer has a 5% stretch tensile modulus of 200–500 kg/cm$^2$, a tan $\delta$ of 0.15–0.50 at 100 Hz, $\pm$0.3% strain and a dynamic storage elastic modulus of 600–1800 kg/cm$^2$, wherein the rubber composition comprising the outer layer of the two layers comprises:

(1') a composition comprises at least one selected from the group consisting of an ethylene-propylene copolymer rubber, a polybutadiene rubber selected from the group consisting of a 1,2-polybutadiene resin, a polyurethane rubber, a natural rubber, a polyisoprene rubber and a styrene-butadiene copolymer rubber, a polychloroprene rubber, a polyacrylate rubber and a polynorbornane rubber, (2') a composition comprising (i) at least one member selected from the group consisting of a nature rubber, a polyisoprene rubber, a styrene-butadiene copolymer rubber, a polychloroprene rubber, an ethylene-propylene copolymer rubber and a polybutadiene rubber, and (ii) a reinforced rubber composition comprising a vulcanizable rubber on which short fiber of a thermoplastic polymer having a thermoplastic polymer having a

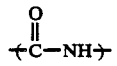

group in the molecule is grafted through a phenolformaldehyde resin precondensate, wherein the content of the short fiber of the thermoplastic polymer in the rubber composition is 2–30 parts by weight per 100 parts by weight of total rubber component or (3') a composition comprising (1), (2) or (3) above wherein the rubber composition comprising the outer layer of the two layers has a 5% stretch tensile modulus of 200–500 kg/cm$^2$ and a tan $\delta$ of 0.15–0.50 at 100 Hz, $\pm$0.3% strain, and wherein the resin of the inner layer of the two layers is a foamed or non-foamed thermoplastic resin or thermosetting resin, wherein the non-foamed resin has a flexural modulus of 20,000–150,000 kg/cm$^2$ and the foamed resin has a flexural modulus of 15,000–35,000 kg/cm$^2$.

* * * * *